US005882431A

United States Patent [19]

Gromov

[11] Patent Number: 5,882,431

[45] Date of Patent: Mar. 16, 1999

[54] METHOD OF CLEANING THE INNER SURFACE OF A STEEL CIRCULATION SYSTEM USING A LEAD BASED LIQUID METAL COOLANT

[75] Inventor: Boris Fedorovich Gromov, Kaluga Region, Russian Federation

[73] Assignee: Gosudhrstvenny Nauchny Tsentr Fiziko-Energetichesky Institut, Obninsk, Russian Federation

[21] Appl. No.: 973,410

[22] PCT Filed: Aug. 6, 1996

[86] PCT No.: PCT/RU96/00219

§ 371 Date: Nov. 17, 1997

§ 102(e) Date: Nov. 17, 1997

[87] PCT Pub. No.: WO97/35156

PCT Pub. Date: Sep. 25, 1997

[30] Foreign Application Priority Data

Mar. 18, 1996 [RU] Russian Federation ..... 96104830

[51] Int. Cl.[6] ..... B08B 9/02

[52] U.S. Cl. ..... 134/22.11; 134/22.12; 134/30; 134/37; 376/305; 376/306; 376/310

[58] Field of Search ..... 134/22.11, 22.12, 134/22.19, 30, 31, 37, 42; 376/310, 366, 365

[56] References Cited

U.S. PATENT DOCUMENTS

| | | | |
|---|---|---|---|
| 2,458,333 | 1/1949 | Brady, Jr. | 134/22.1 |
| 2,671,741 | 3/1954 | Duvall | 134/37 |
| 2,681,657 | 6/1954 | Griffith, Jr. | 134/30 |
| 3,036,011 | 5/1962 | Miller | 252/71 |
| 3,084,076 | 4/1963 | Loucks | 134/30 |
| 3,437,521 | 4/1969 | Buist | 134/30 |
| 3,663,725 | 5/1972 | Pearl | 376/310 |
| 4,042,455 | 8/1977 | Brown | 376/310 |
| 4,287,002 | 9/1981 | Torok | 134/30 |

*Primary Examiner*—Jill Warden
*Assistant Examiner*—Saeed Chaudhry
*Attorney, Agent, or Firm*—Ilya Zborovsky

[57] ABSTRACT

The method is to developed a two-phase flow in the circulation circuit. This method is defined by the fact, that a two-phase flow is developed by means of hydrogen introduction into the coolant. Hydrogen can be introduced in mixture with an inert gas or water steams.

3 Claims, No Drawings

METHOD OF CLEANING THE INNER SURFACE OF A STEEL CIRCULATION SYSTEM USING A LEAD BASED LIQUID METAL COOLANT

The invention is related to heat engineering and can be used in power engineering, transport and nuclear technologies. The cleaning method of internal surfaces of circulation circuits is known. This method comprises the formation of two-phase flow in the circuit by means of gas introduction into liquid coolant. When a two-phase flow is moving along the circuit, a mechanical cleaning of the surfaces from deposits takes place (see "Atomnaya energia", v. 57, I p. 29, 1984).

The disadvantage of the known method is low efficiency of cleaning the circuit internal surface since deposits in such a circuit are solid stable conglomerates, which are strongly connected with an anticorrosive cover on the circuit internal surface. Besides, the deposits removed from the internal surfaces are circulated as a suspended particles in the circuit and they can precipitate (deposit) in "narrow" places of the circuit and blockade partially or completely transport cross-section of the circuit.

The task was to remove deposits from an internal surface of the steel circuit with liquid metal coolant on lead base without damaging an anticorrosive cover on a circuit internal surface. This task is settled in such a way, that the cleaning method of an internal surface of the steel circuit with a liquid metal coolant on lead base is realised by creating a two-phase flow in a circulation circuit, and the two-phase flow is maintained by introduction of hydrogen into the coolant. Hydrogen may be introduced as a pure gas, or being in a mixture with inert gases and with water steam, or in their combination.

Hydrogen introduction into the coolant allows realization, apart from a mechanical action upon deposits, of chemical interaction of deposits with hydrogen according to the reactions of reduction of coolant component oxides. Simultaneous effects of two factors indicated above ensures a deposit total extraction from the circuit internal surface. In this case, the conglomerates are destroyed and their components are carried over by a coolant flow from the circuit internal surface. Besides, hydrogen reduces coolant component oxides which are suspended in the coolant, this solves partially the problem of extracting deposits suspended in a coolant. Introduction of water steam in a coolant prevents reduction of structured material oxides, which contain in an anticorrosive cover. Introducing hydrogen mixed with inert gases allows safety of the process to be improved.

To substantiate a commercial applicability of the method and to achieve the required result, the following experiment results are presented. The samples of sections of internal surfaces with real deposits, which had been formed in the course of operation of different steel circuits with a liquid lead-bismuth eutectic as a coolant (Pb is 44.5%, Bi—55.5%), were divided into uniform six series. In every series there were deposits on samples representing dense layers with thickness up to 1 mm.

The first series of samples was placed into a circuit with eutectic. The coolant circulation velocity in the circuit was 0.5 m/sec. and the temperature was 360° C. Gaseous argon was introduced into the coolant by means of an injector. In this case, a gaseous concentration in the coolant was equal to 1.0% (volume). After the circulation during 100 hours, the samples were extracted out of the circuit and analyzed. The original thickness of deposits on samples did not considerably change.

Then again, the samples were placed into the circuit. A coolant circulation was ensured with the velocity of 0.5 m/s at the temperature of 360° C. Using an injector, a triple gaseous mixture was introduced into the coolant, this mixture contains hydrogen (10% v), argon (88% v), water steam (2% v). After 50 hours of circulation, the samples had been removed and analyzed. The deposits were totally extracted. Therewith, anticorrosive covers remained safe. The experiment described above was repeated with the use of the second sample series at the temperature of 330° C., and the experiment prolongation was raised up to 500 h. Moreover, the coolant filtration unlike other experiments was realized in this experiment. The analysis of the samples being extracted, after the experiment, revealed that the deposits had totally been extracted and, therewith, the anticorrosive covers remained safe. By means of filtration, oxides of iron, chromium and nickel were extracted.

The conditions of experiments with samples of six series/together with described above/are presented in the Table. The results of experiments proved to be the same deposits were extracted, anticorrosive covers were safe.

TABLE

| Experiment parameters | Sample, Number 1 | 2 | 3 | 4 | 5 | 6 |
|---|---|---|---|---|---|---|
| Temperature, °C. | 360 | 330 | 400 | 300 | 400 | 300 |
| Velocity of circulation, m/s | 0.5 | 0.5 | 0.5 | 0.5 | 0.5 | 1.5 |
| Concentration of gas in coolant, % t | 1 | 1 | 1 | 4 | 1 | 1 |
| Concentration $H_2$, % t | 10 | 10 | 10 | 60 | 10 | 30 |
| Concentration Ar, % t | 88 | 88 | 78 | 28 | 20 | 30 |
| Content of steam, % t | 2 | 2 | 12 | 12 | 70 | 40 |
| Operation period, h | 50 | 500 | 50 | 100 | 50 | 100 |

I claim:

1. A method of cleaning a circulation circuit of a cooling system wherein the circulation circuit is constructed of steel and a lead-base liquid metal coolant flows therethrough comprising: introducing hydrogen into said circulation circuit and maintaining a two phase flow of hydrogen and lead-based liquid metal coolant in said circulation circuit.

2. The method of claim 1 wherein the hydrogen is introduced with an inert gas.

3. The method of claim 1 wherein the hydrogen is mixed with water steam.

* * * * *